US010876817B2

(12) United States Patent
Hovsepian

(10) Patent No.: US 10,876,817 B2
(45) Date of Patent: Dec. 29, 2020

(54) HANDGUN LASER SIGHT WITH PASSIVE SWITCH

(71) Applicant: Richard George Hovsepian, Alachua, FL (US)

(72) Inventor: Richard George Hovsepian, Alachua, FL (US)

( * ) Notice: Subject to any disclaimer, the term of this patent is extended or adjusted under 35 U.S.C. 154(b) by 79 days.

(21) Appl. No.: 16/390,192

(22) Filed: Apr. 22, 2019

(65) Prior Publication Data

US 2020/0208942 A1 Jul. 2, 2020

Related U.S. Application Data

(63) Continuation-in-part of application No. 16/104,337, filed on Aug. 17, 2018, now abandoned, which is a continuation of application No. 15/082,816, filed on Mar. 28, 2016, now Pat. No. 10,054,396, which is a continuation-in-part of application No. 14/336,263, filed on Jul. 21, 2014, now Pat. No. 9,328,994, application No. 16/390,192, filed on Apr. 22, 2019, which is a continuation-in-part of application No. 16/104,337, filed on Aug. 17, 2018, now abandoned, which is a continuation of application No. 15/082,816, filed on Mar. 28, 2016, now Pat. No. 10,054,396, and a continuation-in-part of application No. 14/082,322, filed on Nov. 18, 2013, now abandoned.

(51) Int. Cl.
*F41G 1/35* (2006.01)
*F41A 19/69* (2006.01)

(52) U.S. Cl.
CPC ..... *F41G 1/35* (2013.01); *F41A 19/69* (2013.01)

(58) Field of Classification Search
CPC ..... F41G 1/35; F41G 11/001; F41G 11/004; F41G 11/00; F41A 19/69; F41A 33/02
USPC ..... 42/117, 146
See application file for complete search history.

(56) References Cited

U.S. PATENT DOCUMENTS 4,313,273 A * 2/1982 Matthews ..... F41G 11/001 42/117
4,777,754 A * 10/1988 Reynolds, Jr. ..... F41G 1/345 362/110
5,119,576 A * 6/1992 Erning ..... F41A 33/02 362/111
5,194,007 A * 3/1993 Marshall ..... F41A 33/02 42/114
5,485,695 A * 1/1996 Glock ..... F41G 1/35 362/113
5,495,675 A * 3/1996 Huang ..... F41G 1/35 124/87

(Continued)

OTHER PUBLICATIONS

Printed publication titled "Pocket Pistols"—"2012 Buyers Guide", Mar. 2012 Issue # 113, published by Harris Publications of New York, US.; Disclosing document—attached 4 pages.

*Primary Examiner* — Joshua E Freeman
*Assistant Examiner* — Bridget A Cochran
(74) *Attorney, Agent, or Firm* — Sven W Hanson

(57) ABSTRACT

A handgun mounted accessory such as a laser sight is combined with a triggerguard mounted flush profile switch to provide high reliability of operation. The switch is designed and located to provide passive user switching in use without separate movement or applied force of the user's hand or fingers.

10 Claims, 7 Drawing Sheets

(56) References Cited

U.S. PATENT DOCUMENTS 5,557,872 A * 9/1996 Langner ..... F41C 23/22 362/114
5,590,486 A * 1/1997 Moore ..... F41G 1/35 362/110
5,654,594 A * 8/1997 Bjornsen, III ..... H01H 9/06 307/115
5,706,600 A * 1/1998 Toole ..... F41G 1/35 362/114
6,210,771 B1 * 4/2001 Post ..... H05K 3/10 428/100
6,276,088 B1 * 8/2001 Matthews ..... F21L 4/005 362/110
6,363,648 B1 * 4/2002 Kranich ..... F41G 1/35 42/114
6,378,237 B1 * 4/2002 Matthews ..... H01H 3/20 42/124
7,264,369 B1 * 9/2007 Howe ..... F41G 1/35 200/50.32
7,368,921 B2 * 5/2008 Deangelis ..... G01D 5/2405 324/661
7,506,468 B2 * 3/2009 Farrell ..... F41A 17/06 42/70.01
7,845,817 B1 * 12/2010 Miller ..... F41G 1/35 362/110
8,121,283 B2 2/2012 Peng
8,256,154 B2 9/2012 Danielson
8,387,294 B2 * 3/2013 Bolden ..... F41H 13/00 42/1.01
8,683,731 B2 * 4/2014 Kowalczyk ..... F41G 1/35 42/111
8,692,799 B1 * 4/2014 Landry ..... G06F 3/044 345/173
9,328,994 B2 * 5/2016 Hovsepian ..... F41G 1/35
10,054,396 B2 * 8/2018 Hovsepian ..... F41G 1/35
2002/0148153 A1 * 10/2002 Thorpe ..... F41G 1/35 42/114
2005/0252065 A1 * 11/2005 Scherpf ..... F41G 1/34 42/123
2010/0064568 A1 * 3/2010 NuDyke ..... F41A 17/06 42/117
2011/0003269 A1 * 1/2011 Portoghese ..... F41A 33/02 434/18
2011/0107648 A1 * 5/2011 Tuz ..... F41C 9/02 42/117
2012/0144718 A1 * 6/2012 Danielson ..... F41A 19/11 42/117
2013/0185982 A1 * 7/2013 Hilbourne ..... F41G 11/00 42/117
2015/0113851 A1 4/2015 Bensayan
2015/0267998 A1 9/2015 Grace

* cited by examiner

HANDGUN LASER SIGHT WITH PASSIVE SWITCH

BACKGROUND OF THE INVENTION

The present invention pertains to switching mechanisms used to operate and power associated laser sights and similar devices used mounted on handguns. There are many designs of handgun sights that project a laser-produced light beam as a guide for aiming. One of the important features of any laser sight is the manner in which it is switched or powered-on for use. A laser sight is typically unpowered prior to use, but there are many known reasons why it is desirable that the laser be easily and quickly switched on by the user prior to or during aiming. Particularly during events associated with self-defense, when a handgun must be used as a weapon, the ability to switch on a weapon's laser sight without significant mental or physical effort is acknowledged to be critical.

Various laser sight power switches have been developed in the past that attempt to address this need. Some prior art designs have used a switch placed on the handgun grip—operable by the user's middle finger. However, in operation of handguns, there is a phenomena in some users that is referred to as "limp wristing" in which a handgun user does not firmly grasp the handgun grip with the middle finger, but allows that finger to maintain a position curved forward of the grip, under the trigger guard. This event is a problem when the middle is intended and needed to operate a laser sight switch. In such a case, a laser switch located under the trigger guard and on the grip, such as is typified by the designs illustrated in U.S. Pat. No. 8,256,154 to Danielson et al., may not successfully function.

What is desired is a switch to enable powering a laser sight in a handgun that functions without conscience effort by the user and will be effective even when the user's middle finger is not firmly grasping the handgun grip.

Moreover there is a need to provide methods and devices for adaptable mounting laser sights and similar powered devices to a variety of gun frames that have different shapes and configurations.

SUMMARY OF THE INVENTION

The invention provides a laser sight, mountable or mounted on a conventional handgun frame, combined with a flush triggerguard-located switch configured to allow conventional operation of the handgun without interfering with the user's finger movement and without requiring any additional movements or efforts by the user's fingers to control and activate the laser sight. A laser emitting device is contained in a powered device housing located, in use, forward of a handgun triggerguard.

In particular embodiments, the switch is supported and secured to a downward facing outside surface of the handgun triggerguard by means of a flexible switch cover. The flexible nature of the cover, and associated connecting electric leads, allows the laser sight and switch to be mounted together on a variety of different handgun frames while maintaining the flush aspect respecting triggerguard.

In alternative embodiments, the cover has a rigid form with a fixed geometry defined by a specific handgun geometry. The cover may have the form of an integral arm of the powered device housing. In these configurations, the switch may be, alternatively, surface-mounted or, retained within the rigid arm, or retained between the triggerguard and the rigid arm. In non-surface-mounted switches, the switch functions by non-contact means, such as provided by impedance detecting devices or heat sensing devices. In all such configurations, the flush aspect is retained and the switch is operable without force or displacement of the triggerguard, switch or arm structure by the user.

The invention includes a method of improving existing and future handguns by securing a triggerguard-located switch and a laser sight to provide passive user operation of a laser sight during use of the handgun. The invention also includes a method of mounting and controlling a laser sight on a handgun in which a flush switch is surface-mounted to the downward facing outside surface of the triggerguard.

In other embodiments of the invention, the construction and benefits of the inventive control elements are used in conjunction with any of a variety of electrically powered devices that might be used while mounted on a firearm, including for example: an illuminating light, a camera, and a GPS (global positioning system) device.

Other novel aspects and benefits of the invention are made clear from the following description of detailed embodiments and the associated drawing figures. While the invention is discussed in regards to handguns, the same concepts are applicable to other firearms having the same structural features enabling the invention.

DESCRIPTION OF EMBODIMENTS OF THE INVENTION

Figure 1A:
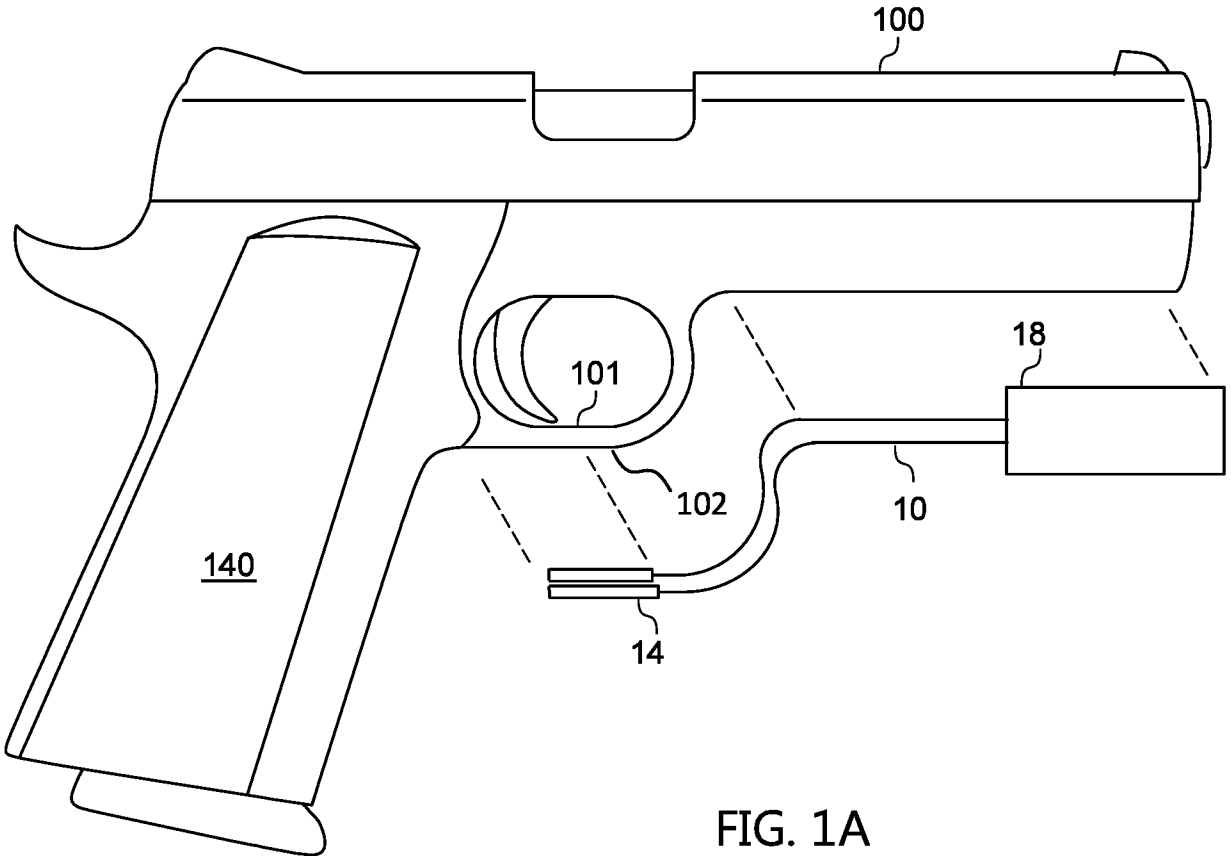
FIG. 1A is a side view of a first embodiment of the invention.

FIG. 1A illustrates some of the fundamental components of one embodiment of the inventive laser sight system. In FIG. 1A, a laser sight 18 and components of a switch 14 and connecting elements are illustrated separated, for illustration purposes, from an associated conventional handgun 100. The handgun 100 is representative of any of various conventional handguns that may have different shapes or forms and that are applicable with the invention. The laser sight 18 is configured to be removably mounted to the handgun 100 through existing conventional hardware features. The manner and devices for mounted the laser sight 18 may include those conventionally found on handguns. Preferably, a "picatinny" style rail system is provided with respective mating structures on the handgun 100 and the laser sight 18 to provide a securing structure. The details of the mating mounting elements are not illustrated but will be well known to anyone knowledgeable of the industry.

In the configuration shown, the switch 14 is located on a downward facing outer surface (DFOS) 102 of the handgun triggerguard 101. The DFOS 102 is a triggerguard surface against which a user's finger conventionally resides and against which the user's finger may slide during typical use. The switch 14 is surface-mounted in form and function with a profile that effectively maintains the flush aspect of the DFOS 102. This "flush" characteristic defines a construction and geometry where the switch 14 does not protrude substantially from the surface on which it is mounted. This characteristic further specifies a configuration that consequently does not create a physical impediment to a user's finger's movement, forward and backward, over the DFOS 102. Details of the switch 14 are provided below.

The switch 14 is connected to a laser sight through electrically conducting flexible traces 10. The traces 10 are surface-mounted and flush and follow, and are secured to, the outside surface of the handgun 100 between the switch 14 and the laser sight 18, including the DFOS 102.

The switch 14 and flexible traces 10 are constructed and configured to enable them to adapt to a variety and range of handgun geometries and surface contour and allow these components to be applied to existing handguns without prior knowledge of the handgun geometry or shape. This requires that the switch 14 and traces 10, at least, are physically flexible while maintaining electrically conductivity. Because the inventive system is intended for use by consumer users without access to any but the simplest tools, the construction of these components must be durable and securable with simple materials.

The traces 10 and switch 14 may be integrally formed as a conductive metallic matrix deposited on a polymer film ribbon carrier or formed from metal sheet fixed to a thin sheet carrier. The traces 10 may be mounted using any of a variety of structural adhesives such as epoxy adhesive. For use on metal gun frames, a nonconductive carrier is required to provide effective electrically insulating characteristics.

The switch 14 must be operable by the user by the simple presence, approach or contact, with and without a contact force against the surface, of the user's finger on a portion of the exposed length of the switch 14. The switch 14 may function through use of electrically separated contact poles that are conductively bridged by contact by the users finger or by detection of local electrical inductance changes due to proximity of the finger. Other alternative control devices having the same characteristics may be used, one example being heat detecting or sensing devices.

It is critical that the location, configuration, and operation of the switch 14 enable powering of the laser sight as a consequence of the natural and inevitable handling of the associated handgun by a user. No additional upward displacement, motion or force on or against the device or switch can be required to be carried out by the user, as such might render the system unlikely to be operated when most critically needed and when the user is most likely to fail to effect switching of power the sight. Particularly, the user must not be required to move any of the gripping fingers or a trigger finger upward nor exert an upward force. However, incidental upward movement or force by the user should not prevent or impede the desired operation.

For the function, the switch 14 should be configured to function whenever a human finger is located anywhere within an effective switching dimension forward of a point on the grip 140 at its junction with the bottom of the triggerguard 101. Experimentation by the inventor here has determined that the effective switching length is dependent on the size of a typical human user's finger and the furthest distance from the grip 140 that a user might place their finger if they did not fully grasp the grip with the middle finger. On this basis, it has been found that the switch 14 itself preferably has an effective extent (length) from a point at a distance of 0.0 to 0.25 inches (0 to 6 millimeters) to a point at a distance of 0.625 inches (16 millimeters) from the grip. The switch 14 may extend to a further distance from the grip 140, but such is believed unnecessary.

Figure 1B:
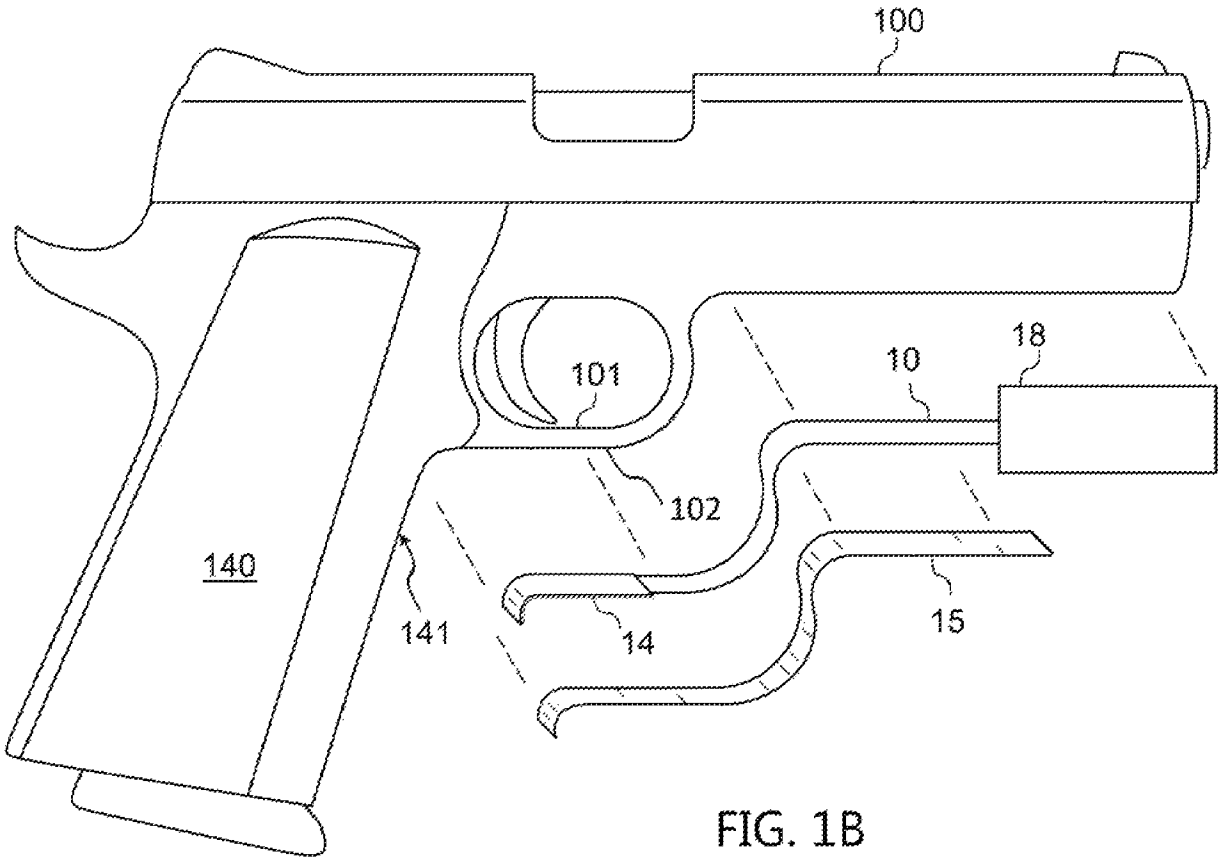
FIG. 1B is a side view of an alternative configuration of the invention.

FIG. 1B illustrates a second configuration of the invention of FIG. 1A. In this configuration, a thin protective cover 15 is secured to the bottom surfaces of the handgun (illustrated separated from the handgun for clarity), including the DFOS 102, capturing traces 10 and switch 14 between the cover 15 and the handgun surface. The principal purpose of the cover 15 is to provide protection to the traces 10 and switch 14 against damage from the environment or from contact from the user. However, the cover 15 may also serve to locate and secure the traces 10 and switch 14. The cover 15 may extend over the entire length of the traces 10 and switch 14 or only a portion thereof. Note that in this configuration, the switch 14 is partially curved to allow it to extend partially onto the vertical forward facing surface 141 of the grip. While incidental to the passive operation of the inventive design, this feature provides addition function and assurance of operation of the powered device. The flush aspect of the design is not impaired.

The cover 15 may be formed of a thin flexible polymer sheet and be secured by any number of conventional adhesives such as a RTV or epoxy adhesive. Other similar flexible nonconductive sheet materials may also be used. The cover 15 should be sufficiently thin as to not perceptibly increase the height of the combination of elements in comparison with the thickness of the traces 10 and switch 14. This is necessary to maintain the flush aspect discussed above. In a prototype devices, a cover sheet material having a thickness less than 0.020 inch was found to meet this requirement of the invention. The effective thickness of the cover sheet may include an adhesive layer. In one configuration, a polyamide film sheet cover having a thickness of 0.004 inch was secured with an adhesive layer having a thickness of about 0.003 for an effective thickness of 0.007 inches which proved satisfactory in maintaining the flush aspect required.

Because in the configuration of FIG. 1B the switch 14 is covered by the cover 15, the switch 14 must function without physical contact by the user's finger. This may be accomplished by including in the switch 14 an inductance sensitive circuit elements or devices. The change in inductance created by an adjacent user's finger may be detected to create a control signal to function as a laser sight switch. The specific characteristics and design or selection of such a device will be clear from the requirements provided here.

Figure 2:
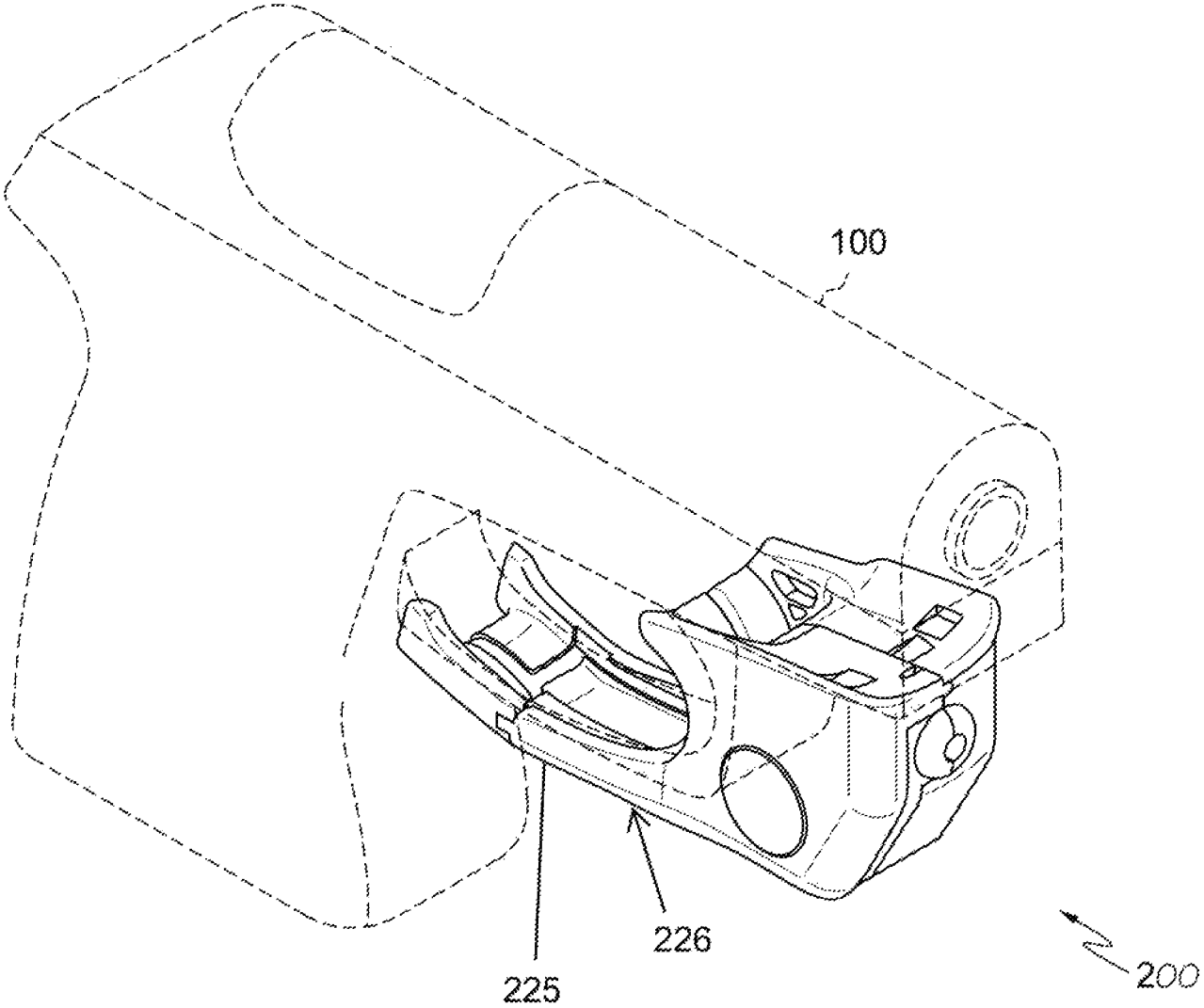
FIG. 2 is a perspective view of a second embodiment of the invention.
Figure 3:
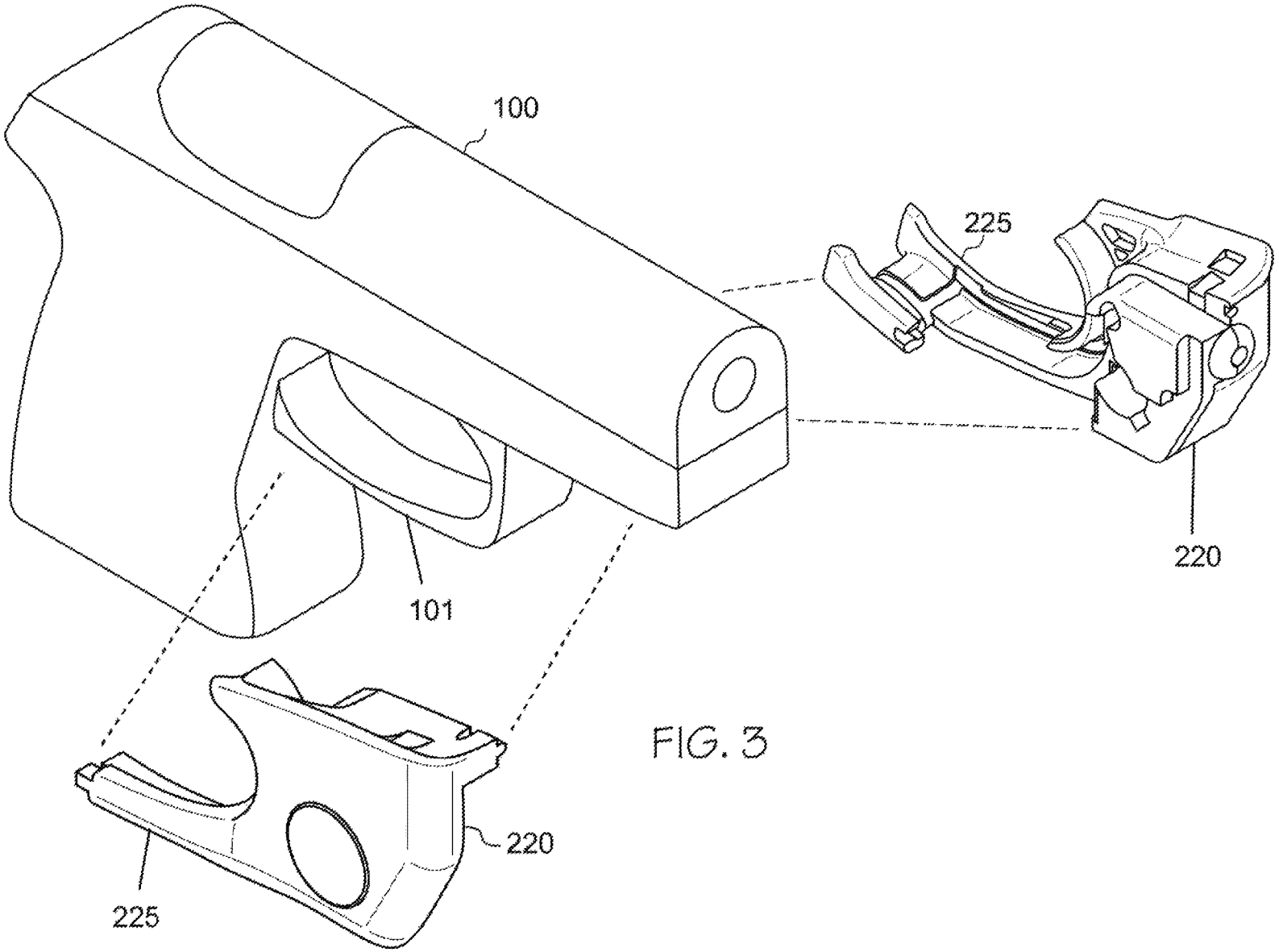
FIG. 3 is an exploded view of the embodiment of FIG. 2.
Figure 4:
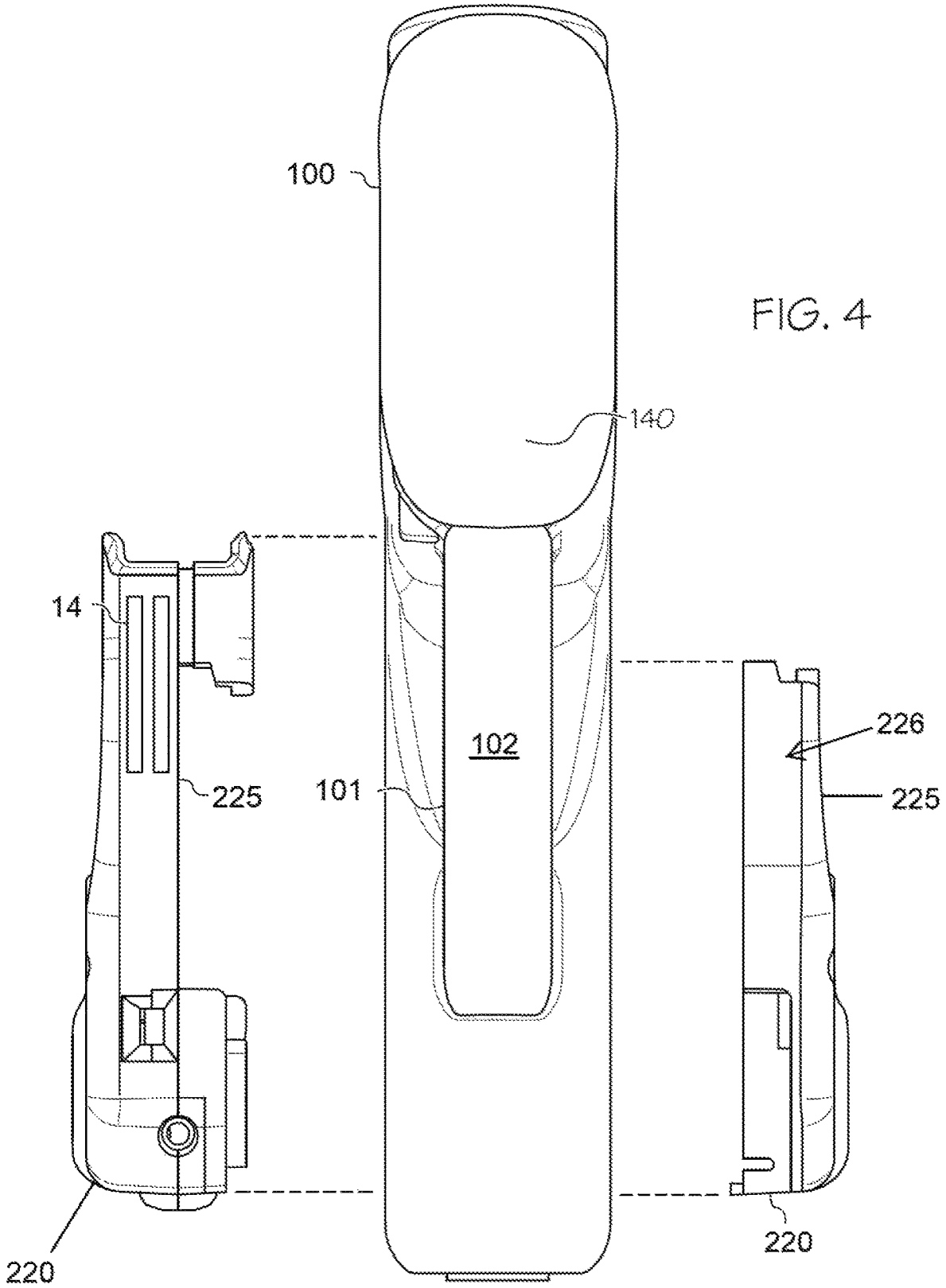
FIG. 4 is a bottom view of the configuration of FIG. 3.

The needed operation and function of the inventive device can be gained in powered device housings with other structural features. For example, the desired protective function and features of the cover 15 of FIG. 1B may be obtained from rigid structures while also maintaining the flush aspect of the invention. In various optional configurations, the cover 15 material may be hardened to a semi-rigid or rigid form after application as described. FIGS. 2 to 5 illustrate an alternative embodiment powered device 200 of the invention wherein the function of the cover 15 is obtained by a rigid arm extending from the powered device 200. FIG. 2 depict the power device 200 in a conventional mounting location forward of the triggerguard—the handgun 100 is shown in FIG. 2 in dashed-line to better illustrate the inventive device. FIG. 3 depicts the powered device 200 as two mating halves, separated as they might be in preparation for mounting. FIG. 4 depicts the handgun 100 and an associated inventive powered device from below, separated into the two mating halves.

In these illustrations, the power device 200 includes a laser light sight, but in alternative configurations the power device 200 may include other powered devices such as illumination lights, cameras or GPS system devices.

In this embodiment, the powered device housing 220 includes a rigid arm 225 which extends from the housing location in front of the triggerguard 101 and then rearward and under and against the triggerguard 101 and its downward facing surface. It is important that the arm 225 extend fully to the grip 140 of the handgun to ensure that no interrupting edge or surface impedes the movement of the user's finger in use, thereby maintaining the flush aspect of the triggerguard respecting the user's finger. The arm 225 effectively provides the functions of the carrier and cover sheet 15 of the prior embodiment in locating, securing and protecting the switch element respecting the user's fingers during use. The arm 225 may include structural elements which extend rearward and next to the sides of the triggerguard 101 to provide rigid and secure attachment there. However, it is important that no portion of the arm 225 extend more than minimally into the handgun triggerguard 101 nor approach the trigger (to avoid impeding normal operation of the handgun).

The arm 225 includes an arm downward facing (ADF) surface 227, which replaces, effectively, the DFOS of the triggerguard with regard to the interaction with the user's fingers. Likewise, the construction and location of the switch 14 in this configuration must satisfy the requirements discussed above respecting its manner of operation and flush aspect. The arm 225 and ADF surface 227 extend sufficiently rearward on the triggerguard 101 to enable locating the switch 14 as discussed above. The arm 225 may also extend downward at its distal end onto the grip 140, so long as its shape and location does not result in displacement of a user's fingers during use.

The arm 225 is rigidly secured to the triggerguard, preferably removeably. This may be accomplished by distinct fastener devices or an engaging fit of the structure of the arm 225 itself or a combination of the two. As shown in FIGS. 3 and 4, the arm 225 may be formed of mating portions that engage together, and with the triggerguard, 101 to secure the arm 225.

In the configurations shown, the traces or other conductive elements or other devices used to electrically connect the switch 14 to the device powered may take forms other from those in the first configuration. Due to the availability of the arm 225 structure, these electrical elements may be conveniently formed on or within the powered device housing 220 prior to attachment of the powered device 200 to a handgun. In this way also, the flush aspect may be ensured by retaining the traces in a location apart from the ADF surface 227 or other exposed location. In the same manner as discussed respecting the configuration of FIG. 1B, a cover 15 may be employed with the embodiment of FIG. 4, covering and protecting the switch 14 (of an inductance type).

Figure 5:
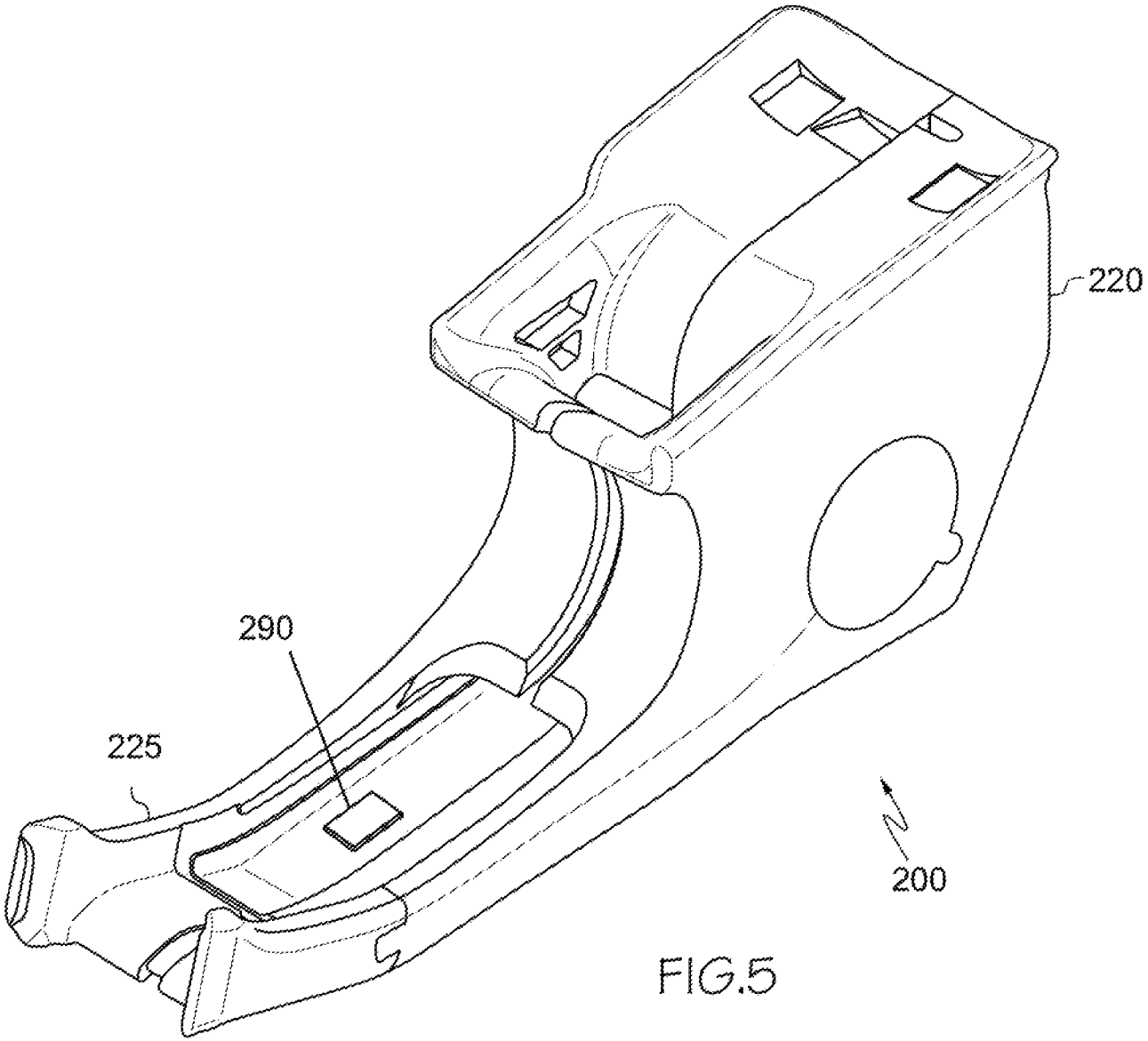
FIG. 5 is a perspective view of the inventive device including an alternative switch device configuration

FIG. 5 is an enlarged illustration of the powered device 200 with an alternative switch device 290. In this configuration, the alternative switch device 290 includes an impedance detection device which is controlled by the changes of local impedance below the arm 225 when the powered device 200 is mounted on the handgun. For this form of switch element, construction of the housing of the powered device of non-metallic materials is preferred for proper function.

Due to the nature of impedance devices, the alternative switch device 290 may be flush surface-mounted on the triggerguard DFOS in the location and manner of the switch previously illustrated or, alternatively, located on or within the arm 225. In this example, for convenience of construction and improved durability, the alternative switch 290 is located within the arm 225 such as to be located adjacent or against the surface of the DFOS when the powered device is mounted.

Figure 6:
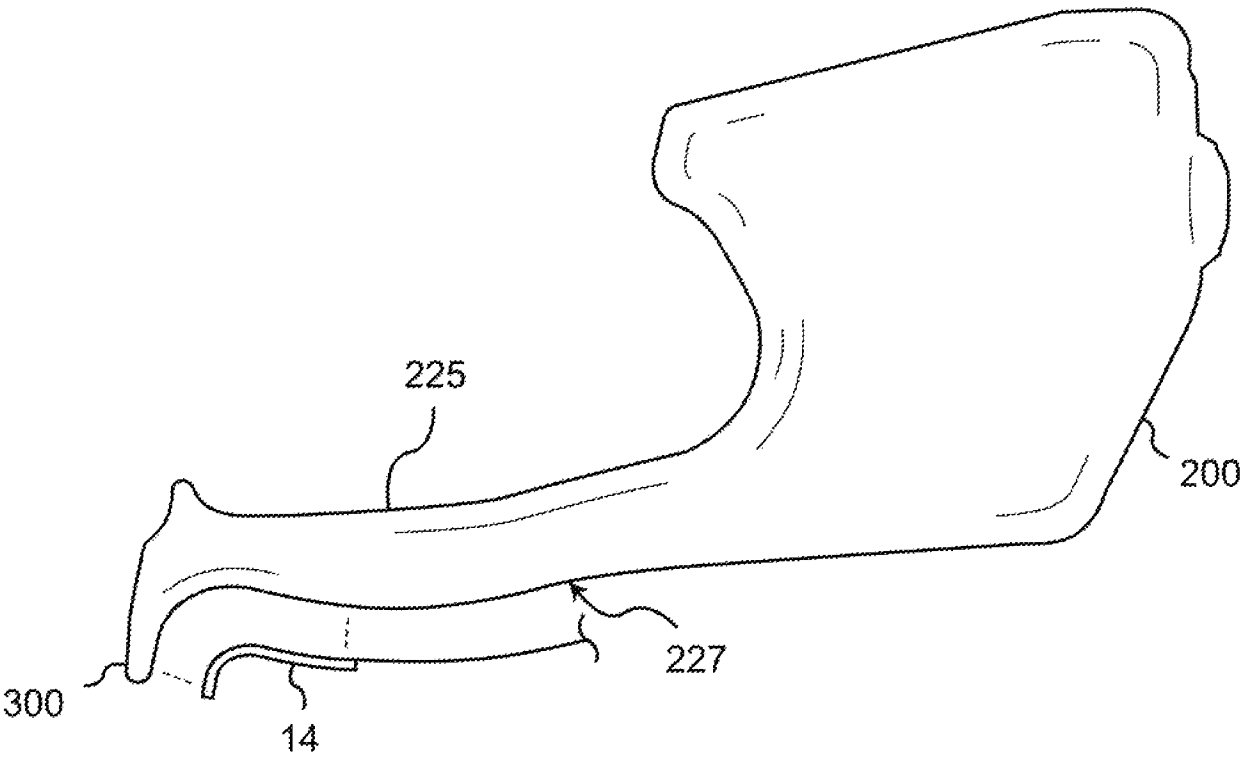
FIG. 6 is a side view of a further alternative configuration of the inventive device.

FIG. 6 illustrates yet a further configuration of the inventive powered device 200. In this configuration, a rigid extension 300 of the powered device extends downwardly from the powered device 200 arm 225, from the rearward extent of the triggerguard, and over the vertical forward-facing surface 141 (FIG. 1B) of the handgun. The switch 14 is configured like that of FIG. 1B, and curved to follow the surface of the extension 300 onto the grip surface 141. This feature provides addition function and assurance of operation of the powered device while maintaining the flush aspect of the design—that is, the extension 300 does not introduce a structure or surface that impedes the movement of the user's fingers as discussed previously. The switch 14 is also located on the arm downward facing surface 227 and there functions identically as discussed above.

In all embodiments of the figures, the flush aspect of the triggerguard is maintained for the purposes of the invention. At the same time, the operation of the switch in all cases is the same as specified above.

The invention includes systems used with any of a variety of firearms having the necessary cooperating features described herein. The term "handgun" is not intended to be limiting on the devices using the inventive concept, and any firearm having the particular features described herein and incorporating the novel features described should be considered within the invention. Similarly, the invention may be employed with alternative active devices such as, for example, an illuminating light in place of the laser light.

The invention claimed is:

1. An accessory for a handgun having a handgun frame including a triggerguard with a triggerguard downward facing outer surface, the accessory comprising:

a powered device removably secured to the handgun frame at a mounting position forward of the handgun triggerguard;

a switch connected to the powered device and enabling control of the powered device, the switch located below the triggerguard downward facing outer surface while retaining flush the downward facing outer surface;

the switch operable by the presence of a human finger located below the triggerguard and without displacement of any portion of the switch and with no force applied onto the switch, and further comprising:

a cover disposed covering the switch and securing the switch to the triggerguard, the cover being flush to the triggerguard;

the switch operable without direct contact by a user.

2. An accessory, according to claim 1, and wherein:

the switch comprises an impedance detecting device.

3. An accessory, according to claim 2, and wherein:

the cover comprises a rigid arm extending rearward from the powered device.

4. An accessory for a handgun having a handgun frame including a triggerguard with a triggerguard downward facing outer surface, the accessory comprising:

a powered device removably secured to the handgun frame at a mounting position forward of the handgun triggerguard;

a switch connected to the powered device and enabling control of the powered device, the switch located below the triggerguard downward facing outer surface while retaining flush the downward facing outer surface;

the switch operable by the presence of a human finger located below the triggerguard and without displacement of any portion of the switch and with no force applied onto the switch, and wherein:

the powered device includes a rigid arm extending below the triggerguard downward facing outer surface and secured to the triggerguard;

the switch is secured to the rigid arm.

5. An accessory, according to claim 4, and wherein:

the rigid arm has a flush arm downward facing outer surface;

the switch comprises two metallic contacts disposed on the arm downward facing outside surface of the rigid arm.

6. An accessory, according to claim 4, and wherein:

the switch comprises an impedance detecting device.

7. An accessory, according to claim 4, and wherein:

the switch is located between the rigid arm and the triggerguard, and the switch is configured to function without direct contact by the user.

8. An accessory, according to claim 7, and wherein:

the switch comprises an impedance detecting device.

9. An accessory, according to claim 4, and wherein:

the switch extends downward from the rearward extent of the triggerguard.

10. An accessory, according to claim 9 wherein:

the rigid arm includes an extension extending downward from the triggerguard, the extension including a portion of the switch.

* * * * *